US010986915B2

(12) United States Patent
Meyer et al.

(10) Patent No.: US 10,986,915 B2
(45) Date of Patent: Apr. 27, 2021

(54) SYSTEM, METHOD AND APPARATUS FOR PAINT BRUSH ACCESSORY

(71) Applicant: BRUSHMASTERS LLC, Glendale, MO (US)

(72) Inventors: Gregory J. Meyer, Glendale, MO (US); Matthew Hutcherson, Lee's Summit, MO (US)

(73) Assignee: BRUSHMASTERS LLC, Glendale, MO (US)

( * ) Notice: Subject to any disclaimer, the term of this patent is extended or adjusted under 35 U.S.C. 154(b) by 208 days.

(21) Appl. No.: 16/219,498

(22) Filed: Dec. 13, 2018

(65) Prior Publication Data

US 2020/0069040 A1 Mar. 5, 2020

Related U.S. Application Data

(63) Continuation-in-part of application No. 29/661,508, filed on Aug. 28, 2018, now Pat. No. Des. 863,784, and a continuation-in-part of application No. 29/661,507, filed on Aug. 28, 2018, now Pat. No. Des. 863,783.

(51) Int. Cl.
*A46B 9/10* (2006.01)
*A46B 17/08* (2006.01)

(52) U.S. Cl.
CPC ..... *A46B 9/10* (2013.01); *A46B 17/08* (2013.01); *A46B 2200/202* (2013.01)

(58) Field of Classification Search
CPC ..... A46B 9/10; A46B 17/08; A46B 2200/202
See application file for complete search history.

(56) References Cited

U.S. PATENT DOCUMENTS

| | | | | |
|---|---|---|---|---|
| 136,288 | A | 2/1873 | Wagner | |
| 987,277 | A | 3/1911 | Wright | |
| 2,558,191 | A | 6/1951 | Nightingale | |
| 3,193,863 | A | 7/1965 | Myers et al. | |
| 4,062,084 | A | 12/1977 | DuBois | |
| 4,129,918 | A | 12/1978 | Lee | |
| 4,847,939 | A * | 7/1989 | Derencsenyi | A46B 17/04 15/246 |
| 5,084,932 | A | 2/1992 | Zasnchi | |
| D492,849 | S | 7/2004 | Goulet et al. | |
| D559,549 | S | 1/2008 | Phillips et al. | |
| D560,366 | S | 1/2008 | Phillips et al. | |
| D562,010 | S | 2/2008 | Goulet et al. | |
| D572,907 | S | 7/2008 | Byrne | |

(Continued)

*Primary Examiner* — Weilun Lo
(74) *Attorney, Agent, or Firm* — Dickinson Wright PLLC; Mark E. Scott

(57) ABSTRACT

A paint brush accessory for a paint brush having a handle with an axis, a ferrule mounted to the handle, bristles extending from a heel of the ferrule, the bristles comprise a belly and a toe that is distal to the belly. The accessory can include a sleeve configured to be slidably mounted to the paint brush in an axial direction about the ferrule. The sleeve can include a continuous body that is hollow in the axial direction. The hollow can be configured to receive and conform to a shape of the ferrule, frictionally engage the ferrule, and be slidably repositionable on the ferrule along the axial direction. A distal end of the hollow can be configured to engage the belly of the bristles to conform an outer shape of the belly of the bristles to a desired uniform pattern.

18 Claims, 7 Drawing Sheets

(56) References Cited

U.S. PATENT DOCUMENTS

| | | | | |
|---|---|---|---|---|
| D727,034 | S | 4/2015 | Lewis | |
| D735,382 | S | 7/2015 | Blanchette | |
| D768,999 | S | 10/2016 | Schlegel et al. | |
| D782,204 | S | 3/2017 | Stein | |
| D784,029 | S | 4/2017 | Hammond | |
| D785,951 | S | 5/2017 | Rosenzweig | |
| 9,642,441 | B1 * | 5/2017 | Ajootian | A46D 1/0207 |
| 2003/0005533 | A1 * | 1/2003 | Woodnorth | B05C 17/0205 15/143.1 |
| 2005/0273962 | A1 | 12/2005 | Dillon | |
| 2012/0294470 | A1 * | 11/2012 | Saltalamacchia | A46B 5/02 381/334 |
| 2014/0075693 | A1 * | 3/2014 | Maslow | A46B 17/08 15/145 |

* cited by examiner

SYSTEM, METHOD AND APPARATUS FOR PAINT BRUSH ACCESSORY

CROSS-REFERENCE TO RELATED APPLICATIONS

This application claims priority to U.S. patent application Ser. No. 29/661,507 filed Aug. 28, 2018 titled "Paint Brush Sleeve" and U.S. patent application Ser. No. 29/661,508 filed Aug. 28, 2018, also titled "Paint Brush Sleeve." Both applications are incorporated by reference herein as if reproduced in full below.

TECHNICAL FIELD

This application relates to paint brushes and, in particular, to a system, method and apparatus for a paint brush accessory.

BACKGROUND

Paint brushes, such as the paint brush 21 shown in FIG. 1A, may comprise a handle 23 having an axis 25, and a ferrule 27 mounted to the handle 23, such as with a crimp 29 and/or fasteners 31 (e.g., nails). The paint brush 21 also has bristles 33 extending from a heel 35 of the ferrule 27. The bristles 33 include a belly 37 and a toe 39 that is distal to the belly 37. The toe 39 can be shaped, such as with a chisel edge (FIG. 1A) or a straight edge (FIG. 1B). In addition, the belly 37 of bristles 39 can have a rectangular profile (FIG. 1A), or a rounded profile (FIG. 1B) when viewed along axis 25. New paint brushes 21 may have very straight bristles 39. In addition, paint brushes are provided in a variety of sizes, such as in the widths of 2 inches, 2.5 inches and 3 inches.

As paint brushes are used over time, some of the bristles 39 of the paint brush 21 can wear and stray (compare FIG. 1C), or even be bent out of shape from the original profile the paint brush 21 had when it was new. Although used or worn paint brushes with stray bristles are still usable, improvements in extending the life of paint brushes continue to be of interest.

SUMMARY

Embodiments of a system, method and apparatus for a paint brush accessory are disclosed. The paint brush can include a handle with an axis, a ferrule mounted to the handle, bristles extending from a heel of the ferrule, the bristles comprise a belly and a toe that is distal to the belly. The accessory can include a sleeve configured to be slidably mounted to the paint brush in an axial direction about the ferrule. The sleeve can include a continuous body that is hollow in the axial direction. The hollow can be configured to receive and conform to a shape of the ferrule, frictionally engage the ferrule, and be slidably repositionable on the ferrule along the axial direction. A distal end of the hollow can be configured to engage the belly of the bristles to conform an outer shape of the belly of the bristles to a desired uniform pattern.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description can be had by reference to the embodiments thereof that are illustrated in the appended drawings. However, the drawings illustrate only some embodiments and therefore are not to be considered limiting in scope as there can be other equally effective embodiments.

The use of the same reference symbols in different drawings indicates similar or identical items.

DETAILED DESCRIPTION

Figure 1C:
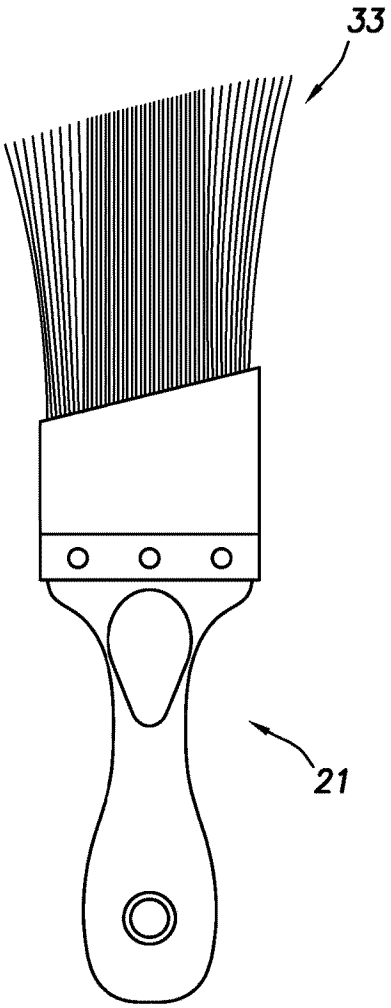
FIG. 1C (PRIOR ART)
FIG. 1C is schematic plan view of a used, worn conventional paint brush.
Figure 1B:
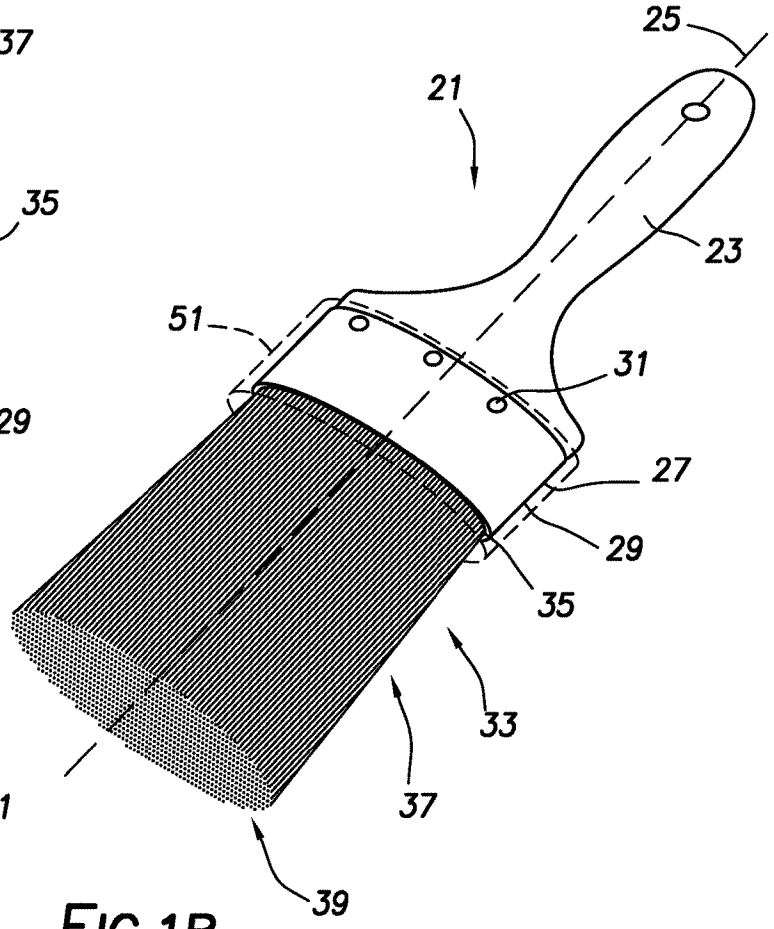
FIG. 1B (PRIOR ART)
FIG. 1B is an isometric view of another conventional paint brush.
Figure 1A:
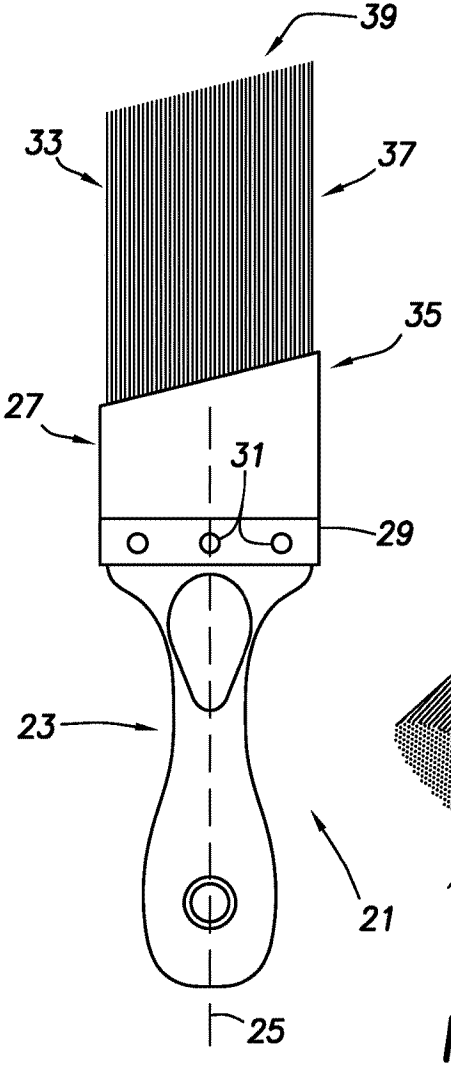
FIG. 1A (PRIOR ART)
FIG. 1A is a front view of a conventional paint brush.
Figure 2:
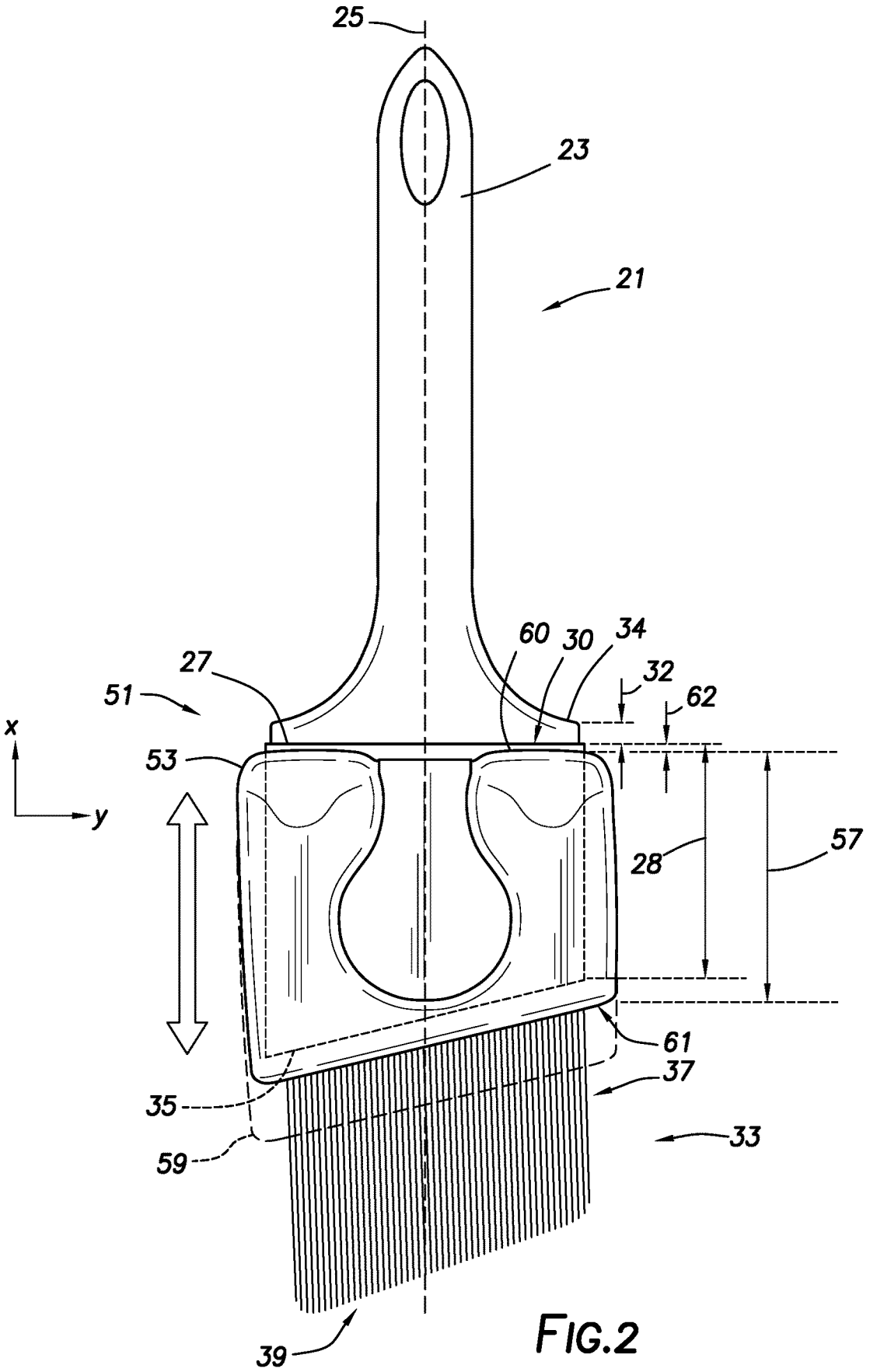
FIG. 2 is a front view of an embodiment of an accessory mounted to a conventional paint brush.
Figure 3:
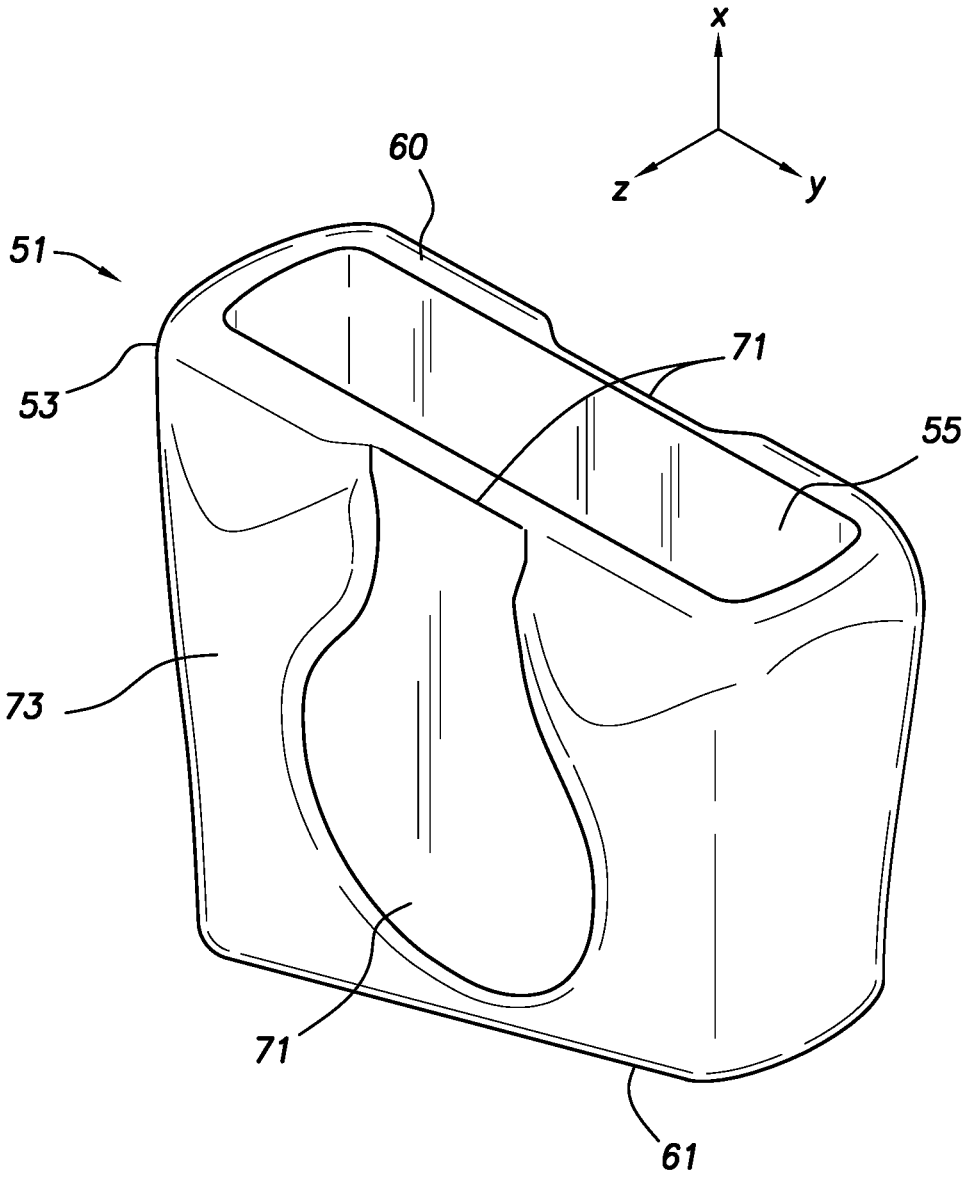
FIG. 3 is a front isometric view of the accessory of FIG. 2.
Figure 4A:
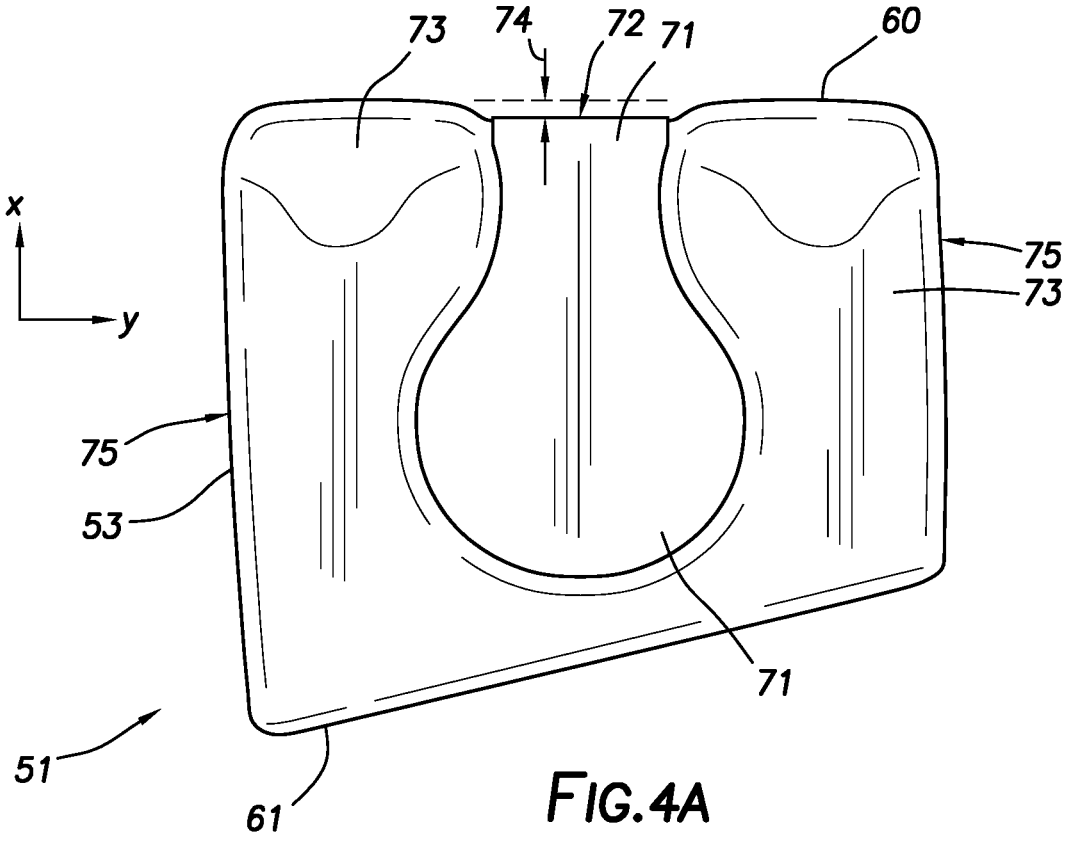
FIG. 4A is a front view of the accessory of FIG. 2.
Figure 4B:
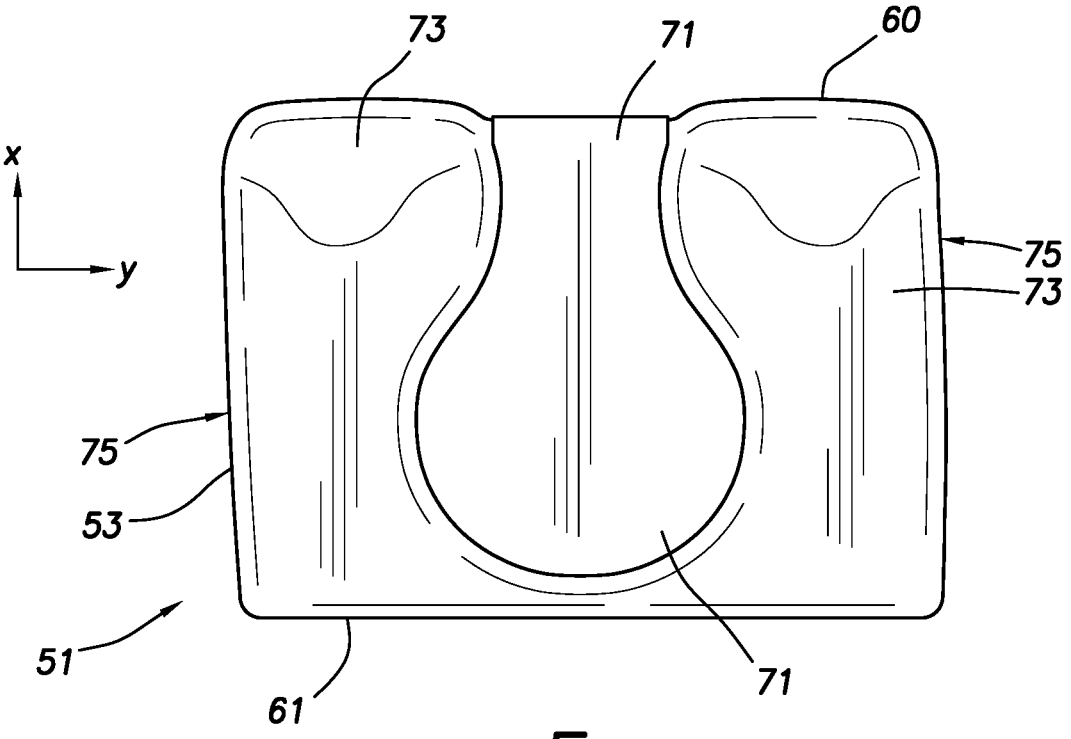
FIG. 4B is a front view of an alternate embodiment of the accessory of FIG. 2.
Figure 5:
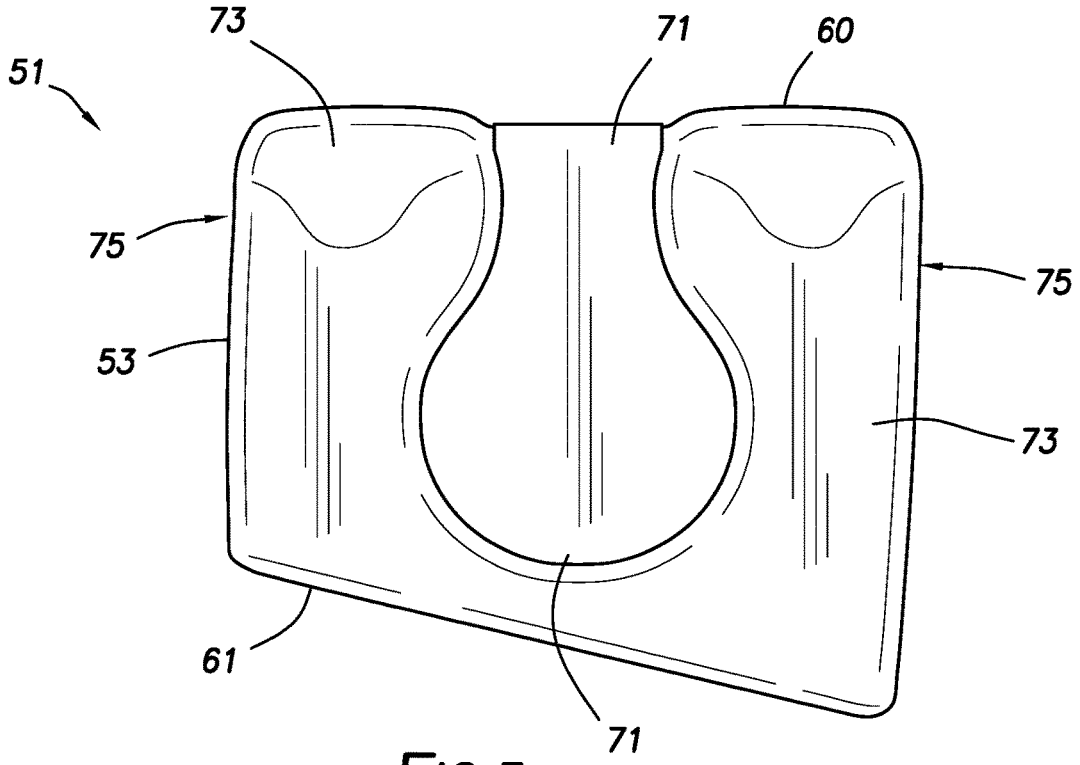
FIG. 5 is a rear view of the accessory of FIG. 2.

FIGS. 2-10 depict embodiments of a system, method and apparatus for a paint brush accessory. For convenience, a Cartesian coordinate system comprising x, y and z axes is provided in the drawings. In some versions, an accessory 51 (FIG. 2) for a related-art paint brush 21 can include a sleeve 53 configured to be slidably mounted to the paint brush 21 in an axial direction (relative to axis 25). The sleeve 53 can be formed from one or more of a variety of elastic materials and frictionally but movably engage the paint brush 21 about the ferrule 27. The sleeve 53 forms a continuous body that is hollow or has a hollow 55 (FIGS. 3, 6, 8 and 9) extending in the axial direction. The hollow 55 is configured to receive and conform to a shape of the ferrule 27, whether the ferrule 27 is rectangular (FIG. 1A) or rounded (FIG. 10C). The hollow 55 can frictionally engage the ferrule 27, and be slidably repositionable along the axial direction.

Figure 10C:
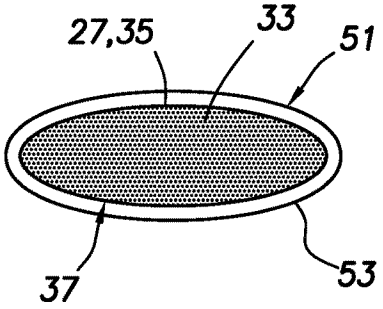
FIG. 10C is an axial sectional view of an embodiment of the accessory installed on the paint brush of FIG. 1B.
Figure 10B:
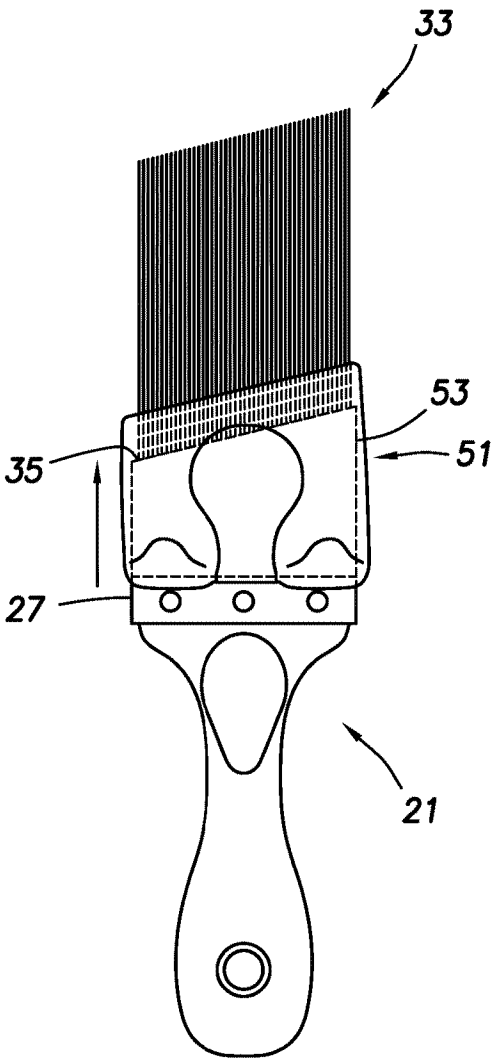
FIGS. 10A and 10B are schematic front views of an embodiment of an accessory for a paint brush in operation.
Figure 10A:
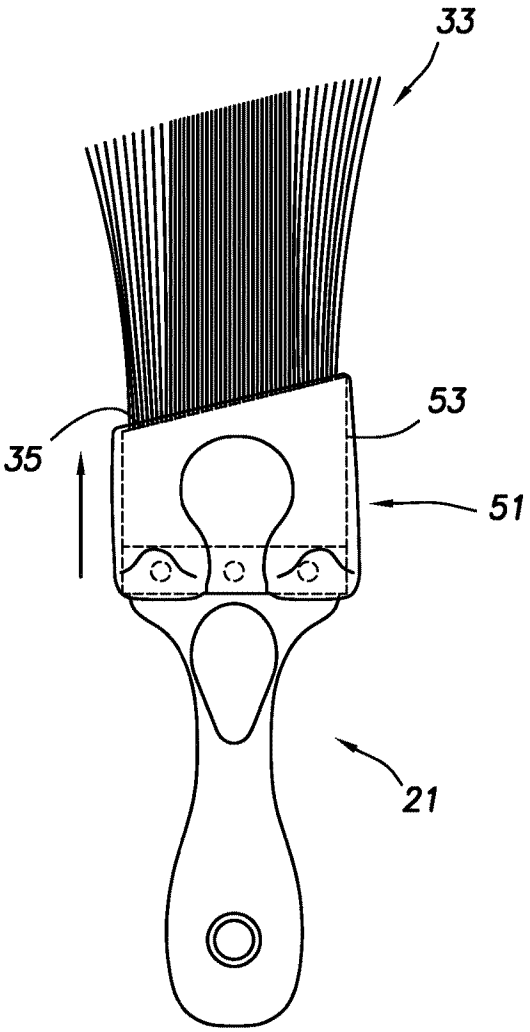

A distal end 61 of the hollow 55 can be configured to engage at least a portion of the belly 37 of the bristles 33. When the accessory 51 is mounted to the paint brush 21, the sleeve 53 can conform an outer shape of the belly 37 to a desired uniform pattern. For example, the desired uniform pattern can be the original pattern of the bristles 33 when the paint brush 21 was new. As shown in FIGS. 10A-10C, the sleeve 53 can conform or return bent or stray bristles 33 that deviate from the original pattern. Accordingly, the accessory 51 can extend the life of older paint brushes by conforming and holding the bristles 33 in their original form or close to it.

Embodiments of the sleeve 53 can have a sleeve axial length 57 (FIG. 2) that can be configured to be greater than a ferrule axial length 28 of the ferrule 27. The distal end 61 of the sleeve 63 can be positioned flush with the heel 35 of the ferrule 27. A proximal end 60 of the sleeve 63 can be flush with or axially displaced by a distance 62 from a proximal end 30 of the ferrule 27. The proximal end 30 of the ferrule 30 can be axially offset by a distance 32 from a shoulder 34 of the handle 23.

In addition, the sleeve 53 can be configured to comprise a range of positions in the axial direction (see phantom position 59) beyond the heel 35 on the paint brush 21. For example, the range of axial positions can position the distal end 61 of the sleeve 53 (or hollow 55) to extend beyond the heel 35 of the ferrule 27 by about 1/16 inch, about 1/8 inch, about 1/4 inch, about 1/2 inch, about 3/4 inch, or about 1 inch, as examples, or ranges thereof. Thus, the distal end 61 of the sleeve 53 or hollow 55 can be configured to surround and cover or overlap at least a portion of the bristles 33 beyond the heel 35 of the ferrule 27 by about 1/16 inch, about 1/4 inch, etc.

Figure 6:
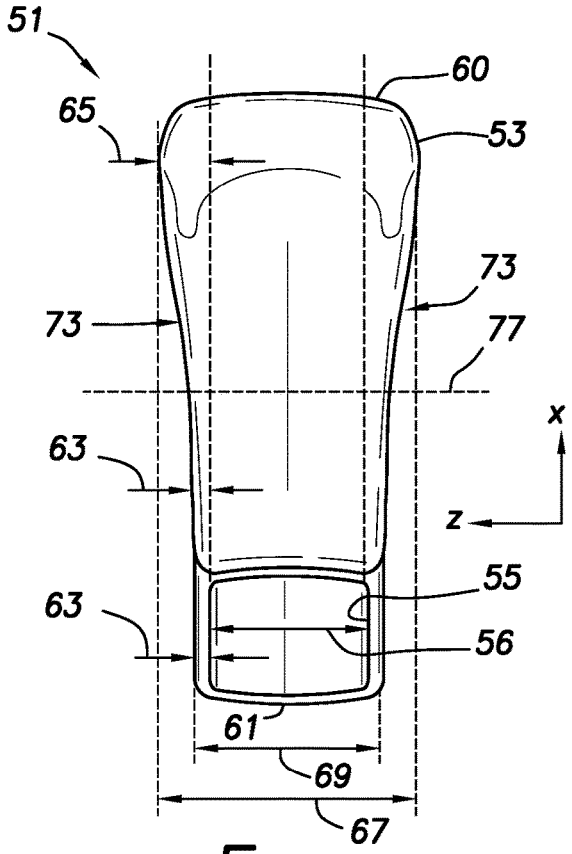
FIGS. 6 and 7 are opposite side views of the accessory of FIG. 2.

In some embodiments, the sleeve 53 has a distal wall thickness 63 (FIG. 6). The distal wall thickness 63 can be in a range of about 1/16 inch to about 1/4 inch, such as 1/10 inch or 1/8 inch. Versions of the sleeve 53 can include a proximal end 60 having proximal wall thickness 65. The proximal wall thickness 65 can be greater than the distal wall thickness 63. The proximal wall thickness 65 can be in a range of about 1/16 inch to about 3/4 inch. In addition, the sleeve 53 can have an outer proximal dimension 67 that is greater than an outer distal dimension 69.

Examples of the hollow 55 can have consistent inner dimensions from the proximal end 60 to the distal end 61. In one version, the hollow 55 can have a constant inner dimension 56 from the proximal end 60 to the distal end 61. The distal end 61 of the sleeve 53 can be configured to match a shape of the toe 39 of the bristles 33, such as a flat edge (FIG. 4B), a chisel edge (FIG. 4A), or another edge shape.

Embodiments of the sleeve 53 can further include recesses 71 (FIGS. 7-9) formed in outer surfaces (e.g., outer faces 73) thereof. Each recess 71 can be configured to receive a finger or thumb of a user of the paint brush 21. Each recess 71 can be finger-shaped or thumb-shaped. Versions of the recesses 71 can extend to and intersect the proximal end 60 of the sleeve 53. A proximal end 72 of each recess 71 can be axially offset by a distance 74 from the proximal end 60 of the sleeve 53. In examples shown (FIGS. 4 and 5), the recesses 71 do not extend to and do not intersect the distal end 61 of the sleeve 53. The recesses 71 can be centered laterally with respect a width of the sleeve 53.

Figure 7:
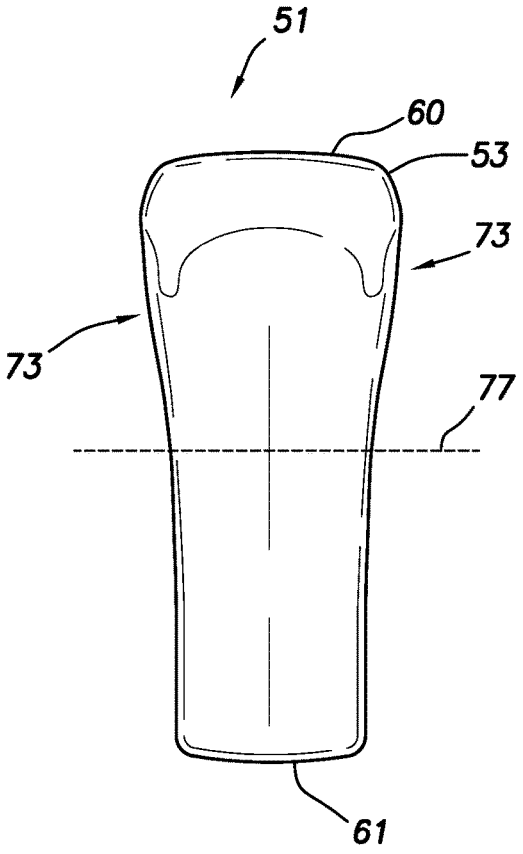
Figure 8:
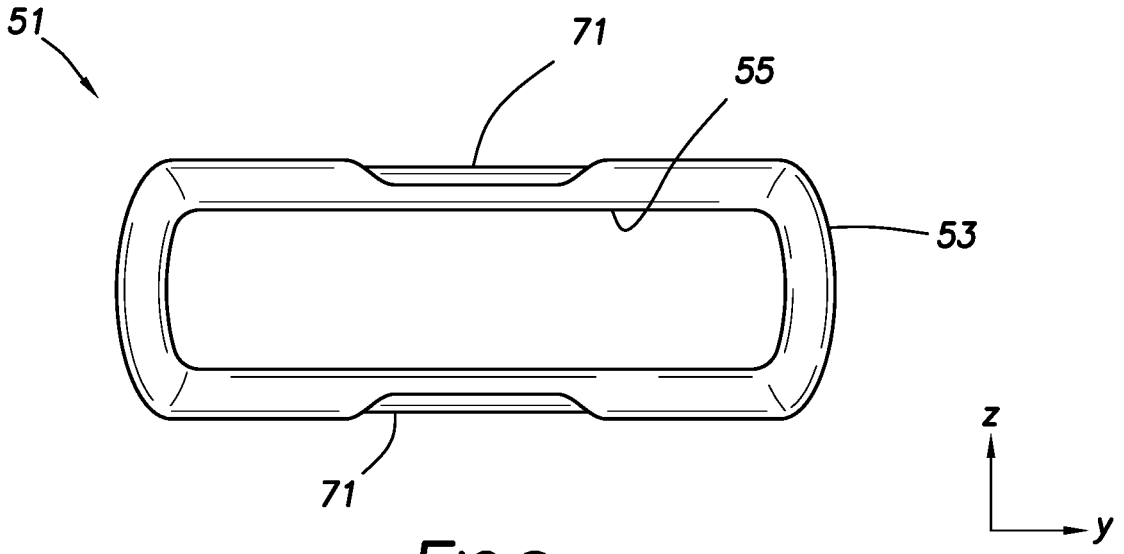
FIGS. 8 and 9 are top and bottom views of the accessory of FIG. 2.
Figure 9:
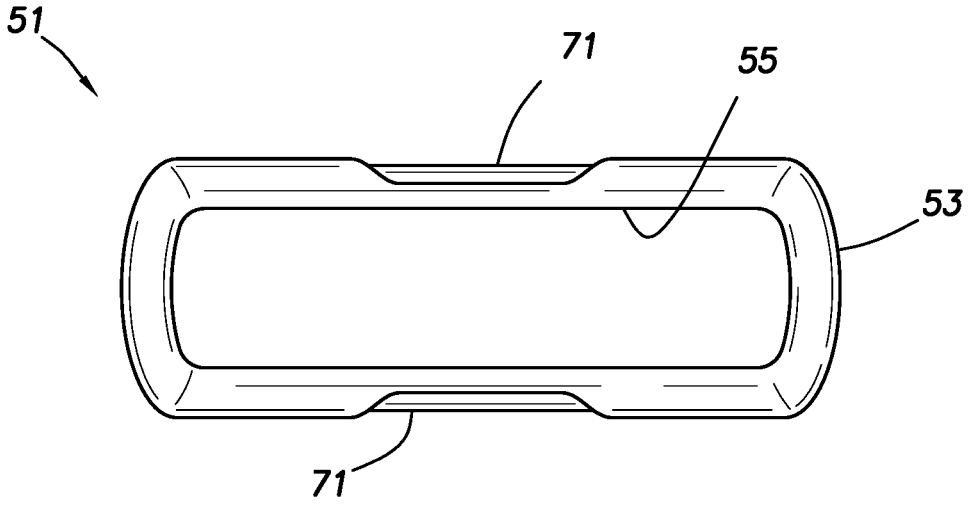

Other versions of the sleeve 53 can include outer sidewalls 75 that are substantially parallel to each other (FIGS. 4 and 5), and outer faces 73 that are tapered (FIGS. 6 and 7). Embodiments of the outer faces 73 can taper down in thickness from the proximal end 60 of the sleeve 53 toward the distal end 61 of the sleeve 53. In particular, the outer faces 73 can taper down in thickness from the proximal end 60 of the sleeve 53 to approximately a longitudinal centerline 77 of the sleeve 53. The outer faces 73 can be substantially parallel to each other from the longitudinal centerline 77 to the distal end 61 of the sleeve 53.

Embodiments of the accessory 51 and sleeve 53 can comprise one or more materials. In one version, the sleeve 53 consists of a single material, such as silica gel, for example. In some versions, the sleeve 53 can be formed from a material having a Shore 00 hardness in a range of about 35 to about 70. Another version of the sleeve 53 can be formed from a material having a Shore 00 hardness in a range of about 40 to about 55. In addition, when the sleeve 53 is installed on the paint brush 21, the sleeve 53 can be configured to resist paint uptake into the ferrule 27 of the paint brush 21.

In still other embodiments, a method of adjusting at least one of a shape and a stiffness of bristles 33 of a paint brush 21 are disclosed. For example, the method can include providing a sleeve 53 having a hollow 55 shaped like an exterior of the paint brush 21. The sleeve 53 can be formed from an elastomeric material. The method can include inserting a handle 23 of the paint brush 21 (FIG. 10A) into and through the hollow 55 of the sleeve 53, such that the handle 23 extends from a proximal end 60 of the sleeve 53, and bristles 33 of the paint brush 21 extend from a distal end 61 of the sleeve 53.

The method can continue by adjusting a position (FIG. 2) of the sleeve 53 such that the distal end 61 of the sleeve 53 extends beyond a heel 35 of a ferrule 27 of the paint brush 21 (FIG. 10B) and overlaps at least a portion of a belly 37 of the bristles 33. The proximal end 60 of the sleeve 53 can be substantially aligned with a proximal end of the ferrule 27 adjacent to the handle 23, or slightly gapped (FIG. 2), such that the distal end 60 of the sleeve 53 extends past the heel 35 of the ferrule 27 and at least partially overlaps the bristles 33 in a nominal position.

In addition, the method can include painting with the paint brush 21 while the paint brush 21 is mounted in the sleeve 53, and then adjusting the position of the sleeve 53 to further overlap the belly 37 of the bristles 33 with the distal end 61 of the sleeve 53. In this way, the bristles 33 can be stiffened by the sleeve 53 in a stiffened position. Further painting with the paint brush 21 can be performed while the sleeve 53 is in the stiffened position.

Other versions can include one or more of the following embodiments.

1. An accessory for a paint brush, the paint brush having a handle with an axis, a ferrule mounted to the handle, bristles extending from a heel of the ferrule, the bristles comprise a belly and a toe that is distal to the belly, and the accessory comprising:

a sleeve configured to be slidably mounted to the paint brush in an axial direction about the ferrule, the sleeve comprising a continuous body that is hollow in the axial direction, the hollow is configured to receive and conform to a shape of the ferrule, frictionally engage the ferrule, and be slidably repositionable on the ferrule along the axial direction, and a distal end of the hollow is configured to engage the belly of the bristles to conform an outer shape of the belly of the bristles to a desired uniform pattern.

2. The accessory of any of these embodiments, wherein the sleeve has a sleeve axial length that is configured to be greater than a ferrule axial length of the ferrule.

3. The accessory of any of these embodiments, wherein a distal end of the sleeve is configured to match a shape of the toe of the bristles.

4. The accessory of any of these embodiments, wherein the sleeve is configured to comprise a range of positions in the axial direction on the paint brush, and the range comprises about 1/8 inch to about 3/4 inch.

5. The accessory of any of these embodiments, wherein the distal end of the hollow is configured to overlap the bristles beyond the heel of the ferrule by about 1/16 inch to about 1/4 inch.

6. The accessory of any of these embodiments, wherein the sleeve is configured to adapt to a shape of paint brush having a substantially rectangular ferrule, and to a non-rectangular ferrule.

7. The accessory of any of these embodiments, wherein the sleeve has a wall thickness in a range of about 1/16 inch to about 1/4 inch.

8. The accessory of any of these embodiments, wherein the sleeve has an outer proximal dimension that is greater than an outer distal dimension.

9. The accessory of any of these embodiments, wherein the hollow has consistent inner dimensions from the proximal end to the distal end.

10. The accessory of any of these embodiments, wherein the hollow has constant inner dimensions from the proximal end to the distal end.

11. The accessory of any of these embodiments, wherein the sleeve further comprises recesses formed in outer surfaces thereof, wherein each recess is configured to receive a finger or thumb of a user of the paint brush, and each recess is generally finger-shaped or generally thumb-shaped.

12. The accessory of any of these embodiments, wherein the recesses extend to and intersect a proximal end of the sleeve, and the recesses do not extend to and do not intersect a distal end of the sleeve.

13. The accessory of any of these embodiments, wherein the recesses are centered laterally with respect a width of the sleeve.

14. The accessory of any of these embodiments, wherein the sleeve has outer sidewalls that are substantially parallel to each other, and outer faces that are tapered.

15. The accessory of any of these embodiments, wherein the outer faces taper down in thickness from a proximal end of the sleeve toward a distal end of the sleeve.

16. The accessory of any of these embodiments, wherein the outer faces taper down in thickness from a proximal end of the sleeve to approximately a longitudinal centerline of the sleeve, and the outer faces are substantially parallel from the longitudinal centerline to a distal end of the sleeve.

17. The accessory of any of these embodiments, wherein the sleeve comprises silica gel.

18. The accessory of any of these embodiments, wherein the sleeve is formed from a material having a Shore 00 hardness in a range of about 40 to about 55.

19. The accessory of any of these embodiments, wherein the sleeve, when installed on the paint brush, is configured to resist paint uptake into the ferrule of the paint brush.

20. A method of adjusting at least one of a shape and a stiffness of bristles of a paint brush, the method comprising:

(a) providing a sleeve having a hollow shaped like an exterior of a paint brush, the sleeve being formed from an elastomeric material;

(b) inserting a handle of the paint brush into and through the hollow of the sleeve, such that the handle extends from a proximal end of the sleeve and bristles of the paint brush extend from a distal end of the sleeve;

(c) adjusting a position of the sleeve such that the distal end of the sleeve extends beyond a heel of a ferrule of the paint brush and overlaps at least a portion of a belly of the bristles;

(d) painting with the paint brush while the paint brush is mounted in the sleeve.

(e) adjusting the position of the sleeve to further overlap the belly of the bristles with the distal end of the sleeve, such that the bristles are stiffened by the sleeve in a stiffened position; and then (f) painting with the paint brush while the sleeve is in the stiffened position.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The term "discreet," as well as derivatives thereof, references to the amount of skin exposed by a user of the garment, rather than the type of style of the garment. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

What is claimed is:

1. An accessory for a paint brush, the paint brush having a handle with an axis, a ferrule mounted to the handle, bristles extending from a heel of the ferrule, the bristles comprise a belly and a toe that is distal to the belly, and the accessory comprising:

a sleeve configured to be slidably mounted to the paint brush in an axial direction surrounding the ferrule, the sleeve comprising a continuous body that is hollow in the axial direction, the hollow is configured to receive and conform to a shape of the ferrule, frictionally engage the ferrule, and be slidably repositionable on the ferrule along the axial direction, and a distal end of the hollow is configured to engage the belly of the bristles to conform an outer shape of the belly of the bristles to a desired uniform pattern;

wherein the sleeve has outer sidewalls that are substantially parallel to each other; and wherein the sleeve has outer faces that taper down in thickness from a proximal end of the sleeve toward a distal end of the sleeve.

2. The accessory of claim 1, wherein the sleeve has a sleeve axial length that is configured to be greater than a ferrule axial length of the ferrule.

3. The accessory of claim 1, wherein a distal end of the sleeve is configured to match a shape of the toe of the bristles.

4. The accessory of claim 1, wherein the sleeve is configured to comprise a range of positions in the axial direction on the paint brush, and the range comprises ⅛ inch to ¾ inch.

5. The accessory of claim 1, wherein the distal end of the hollow is configured to overlap the bristles beyond the heel of the ferrule by 1/16 inch to ¼ inch.

6. The accessory of claim 1, wherein the sleeve is configured to adapt to a shape of paint brush having a substantially rectangular ferrule, and to a non-rectangular ferrule.

7. The accessory of claim 1, wherein the distal end of the sleeve has a wall thickness in a range of 1/16 inch to ¼ inch.

8. The accessory of claim 1, wherein the sleeve has an outer proximal dimension that is greater than an outer distal dimension.

9. The accessory of claim 8, wherein the hollow has consistent inner dimensions from the proximal end to the distal end.

10. The accessory of claim 8, wherein the hollow has constant inner dimensions from the proximal end to the distal end.

11. The accessory of claim 1, wherein the sleeve further comprises recesses formed in outer surfaces thereof, wherein each recess is configured to receive a finger or thumb of a user of the paint brush, and each recess is generally finger-shaped or generally thumb-shaped.

12. The accessory of claim 11, wherein the recesses extend to and intersect a proximal end of the sleeve, and the recesses do not extend to and do not intersect a distal end of the sleeve.

13. The accessory of claim 11, wherein the recesses are centered laterally with respect a width of the sleeve.

14. The accessory of claim 1, wherein the outer faces taper down in thickness from a proximal end of the sleeve to approximately a longitudinal centerline of the sleeve, and the outer faces are substantially parallel from the longitudinal centerline to a distal end of the sleeve.

15. The accessory of claim 1, wherein the sleeve comprises silica gel.

16. The accessory of claim 1, wherein the sleeve is formed from a material having a Shore 00 hardness in a range of 40 to 55.

17. The accessory of claim 1, wherein the sleeve, when installed on the paint brush, is configured to resist paint uptake into the ferrule of the paint brush.

18. A method of adjusting at least one of a shape and a stiffness of bristles of a paint brush, the method comprising:

(a) providing a sleeve having a hollow shaped like an exterior of a paint brush, the sleeve being formed from an elastomeric material (b) inserting a handle of the paint brush into and through the hollow of the sleeve, such that the handle extends from a proximal end of the sleeve and bristles of the paint brush extend from a distal end of the sleeve;

(c) adjusting a position of the sleeve such that the distal end of the sleeve extends beyond a heel of a ferrule of the paint brush and overlaps at least a portion of a belly of the bristles;

(d) painting with the paint brush while the paint brush is mounted in the sleeve;

(e) adjusting the position of the sleeve to further overlap the belly of the bristles with the distal end of the sleeve, such that the bristles are stiffened by the sleeve in a stiffened position; and then (f) painting with the paint brush while the sleeve is in the stiffened position.

* * * * *